United States Patent [19]

Danzer

[11] 4,199,177

[45] Apr. 22, 1980

[54] LOCKING MECHANISM

[76] Inventor: Robert Danzer, Box No. 242, White Sulphur Springs, N.Y. 12787

[21] Appl. No.: 882,578

[22] Filed: Mar. 2, 1978

[51] Int. Cl.[2] ..... E05C 1/06

[52] U.S. Cl. ..... 292/144; 292/DIG. 43

[58] Field of Search ..... 292/201, 144, DIG. 25, 292/DIG. 43, 33; 70/256, 257, 240, 241, 275, DIG. 48

[56] References Cited

U.S. PATENT DOCUMENTS

| | | | |
|---|---|---|---|
| 1,555,174 | 9/1925 | Williams | 292/DIG. 25 |
| 2,111,687 | 3/1938 | Webb | 292/33 X |
| 2,688,865 | 9/1954 | Foster et al. | 292/144 X |
| 3,016,968 | 1/1962 | Lenz et al. | 292/DIG. 43 |
| 3,081,078 | 3/1963 | Lohr | 292/DIG. 43 |
| 3,113,447 | 12/1963 | Oishei | 292/DIG. 43 |
| 3,166,144 | 1/1965 | Price | 292/144 X |
| 3,345,839 | 10/1967 | Brissette | 70/240 |
| 3,403,934 | 10/1968 | Butts | 292/144 X |

FOREIGN PATENT DOCUMENTS

| | | | |
|---|---|---|---|
| 2063325 | 9/1971 | France | 292/33 |

*Primary Examiner*—J. Franklin Foss

*Attorney, Agent, or Firm*—John Maier, III

[57] ABSTRACT

A pair of plungers engage the hinges of an automobile trunk, said plungers being actuated by a piston and cylinder assembly connected to the vacuum manifold of the automobile by a conduit with a valve located in said conduit.

11 Claims, 3 Drawing Figures

LOCKING MECHANISM

BACKGROUND OF THE INVENTION

1. Field of the Invention.

This invention provides a locking mechanism. More specifically, this invention provides a locking mechanism that secures the trunk of a motor vehicle separately from the usual automobile trunk lock and operates from the vacuum intake on the engine of the motor vehicle.

2. Description of the Prior Art.

Remotedly-operated trunk opening devices have been used. It is the normal practice to operate a trunk locking device so as to be able to open or lock the trunk from the interior of the automobile but by using the usual key-operated lock of the motor vehicle. With the ready availability of battery-operated electric drills, it has become commonplace for thieves to enter the trunks of motor vehicles quickly and easily by means of drilling through the lock. Therefore, there is a great need for a remotely-operated trunk lock which is not readily assessible to be drilled and which is separate and distinct from the usual key-operated automobile truck lock.

The use of the vacuum of the internal combustion engine of the motor vehicle for actuating devices including locks is well known. U.S. Patents which are of interest to this invention are as follows:

| Inventor | Patent Number |
|---|---|
| Tucker | 3,805,566 |
| Peters | 3,596,484 |
| Peters | 3,580,623 |
| Brissette | 3,345,839 |
| Nallinger | 3,124,950 |
| Lenz et al | 3,016,968 |
| Christopher | 3,723,419 |
| Chayne | 2,647,789 |

By use of this invention, the trunk of the vehicle cannot be opened unless the automobile is running. Since it is located in engagement with the upper hinges, no amount of destruction to the normal key-operated automobile lock will permit opening of the trunk lid. Obviously, if the thief is capable of starting the automobile engine, he will probably remove the entire vehicle anyway. However, this invention would prohibit entering the trunk providing the car cannot be started absent a total dismembering of the automobile itself.

In view of the large incidents of thievery from automobiles and the natural tendency of persons leaving their vehicle in a parking area to lock their valuables in the trunk, it is a highly desirable feature of any present-day automobile to include a second locking mechanism for the trunk which can only be actuated from the interior of the car with the engine running.

SUMMARY OF THE INVENTION

The present invention accomplishes its desired objectives by utilizing a pair of locking plungers which penetrate through the hinges of the trunk so as to prevent the hinges from being lifted upward. A pair of spring-loaded vacuum-actuated plungers engage the hinges of the trunk lid preventing the automobile trunk from being opened. A conduit exgtends from the pair of vacuum-actuated cylinders to a control switch located in the interior of the vehicle and from the switch to the vacuum manifold of the engine of the automobile.

Further the present mechanism accomplishes its desired objectives with the simplicity of utilizing the vacuum of the automobile engine with parts which can be readily installed and made available in a kit form.

Still another object of the invention is to provide a relatively inexpensive mechanism which can be easily installed on an existing car.

The foregoing objects, advantages, features and results of the present invention, together with various other objects, advantages, features and results which will be evident to those skilled in the art in the light of this disclosure, may be achieved with the exemplary embodiment of the invention illustrated in the accompanying drawings and described in detail hereinafter.

DESCRIPTION OF PREFERRED EMBODIMENT

Figure 2:
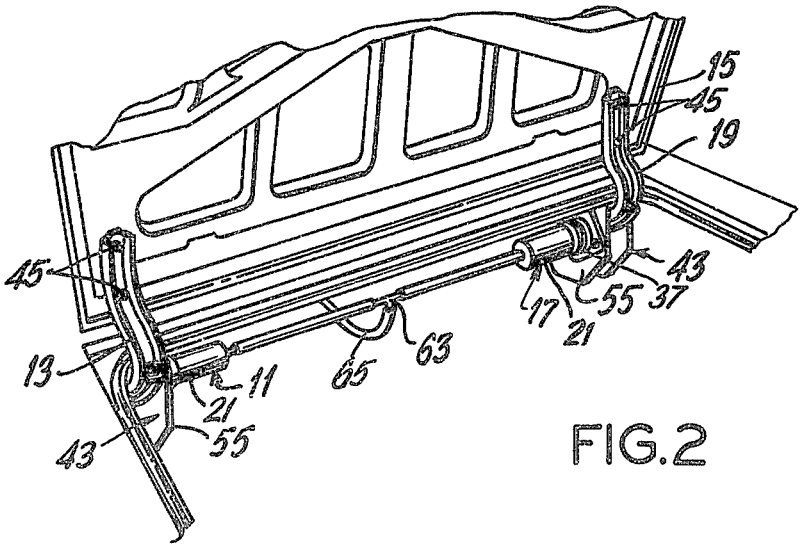
FIG. 2 is a perspective view showing the pair of vacuum actuated cylinders and plungers installed in the vehicle.
Figure 3:
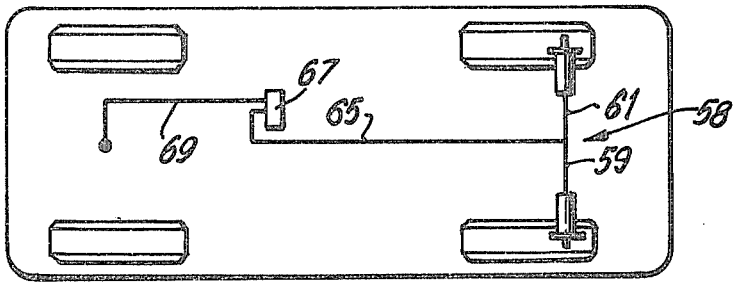
FIG. 3 is a schematic view showing the pneumatic circuitry of the system.

This invention provides a lock mechanism for the trunk of a motor vehicle that utilizes the vacuum of the vehicles's internal combustion engine. As best seen in FIG. 2, a left piston and cylinder assembly 11 is mounted by the left hinge 13 of a trunk lid 15. Similarly, a right piston and cylinder assembly 17 is mounted by the right hinge 19. Both piston and cylinder assemblies 11, 17 include a cylinder 21 with an air inlet 23 at a closed end 25. The cylinder 21 is in the form of a hollow cylindrical member having an open end 27 opposite the closed end 25. A piston 29 is located in the cylinder 21 with a spring 31 extending from the piston 29 against the closed-end 25 of the cylinder 21 where the air inlet 23 is located. A plunger 33 generally in the form of a elongated rod extends from the piston 29 out the open end 27 of the cylinder 21. The open end 27 of the cylinder 21 has an external thread 35. A cylindrical cap 37 holds the spring 31 and piston 29 within the cylinder 21. A concentric opening 39 at the end of the cap 37 permits the plunger or elongated rod 33 to extend through it. The cap 37 has in internal thread 41 to receive the external thread 27 of the cylinder 21.

It is a standard design for the trunk lid hinge of an automobile to be located in a channel member 43. Both the left hinge 13 and the right hinge 19 are pivotly mounted in their respective channel member 43. Both hinges 13, 19 are rigidly secured to the upper edge of the trunk lid 15 by means, as for example, bolts 45 as shown in FIG. 2. In both piston and cylinder assemblies 11, 17 a mounting plate 47 is secured to the channel member 43 and the cylinder cap 37 is secured, preferable by bolting or welding (not shown) to the mounting plate 47. By drilling a pair of holes 49 in the side of the channel and a pair of holes 51 in the plate 47, bolts 53 are used to secure the mounting plate 47 to the opposing interior sides 55 of both the channel member 43 wherein the left hinge 13 is mounted and the channel member 43 wherein the right hinge 19 is mounted. A third hole 57 must also be provided to permit the elongated rod or plunger 33 to penetrate through each channel member 43.

Figure 1:
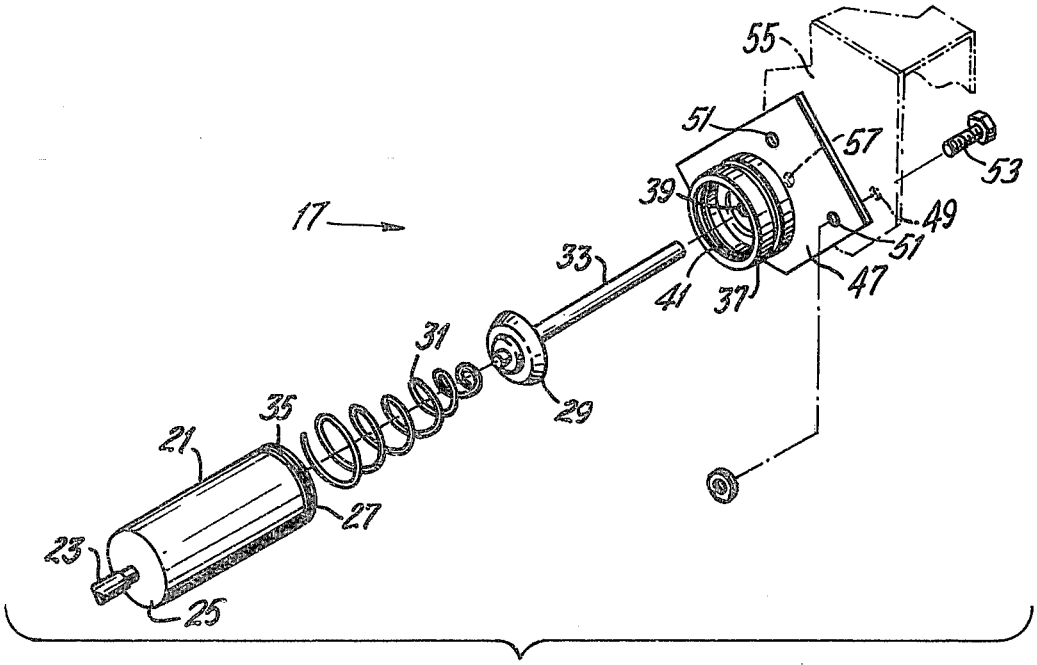
FIG. 1 is an exploded perspective view of a portion of the invention showing one vacuum cylinder and plunger in relationship to one trunk hinge of an automobile.

As seen in FIG. 2, the right piston and cylinder assembly 17 shown mounted by right hinge 19 of the trunk lid 15 in FIG. 1 is duplicated as a mirror image on the left side as the left piston and cylinder assembly 11. In this way, the locking mechanism may utilize not just a cylinder 21 but a pair of cylinders 21 and a pair of air inlets 23, and a pair of pistons 29 and springs 31 along with a pair of elongated rods 33. A conduit means 58 connects the left and right assemblies 11, 17 to the vacuum manifold (not shown). A left conduit section 59 is connected to the left piston and cylinder assembly 11 and a right conduit section 61 is connected to the right piston and cylinder assembly 17 by means of a tee 63. A rear conduit section 65 extends from the tee 63 to a valve 67 located within the interior of the automobile preferably on the dash board near the driver's seat. A forward conduit section 69 extends from a valve 67 to the vacuum manifold (not shown) of the motor vehicle.

In the absence of a vacuum, when the valve 67 is closed, the piston and cylinder assemblies 11, 17 due to the force of the spring, will force the plunger or elongated rod 33 into the channel member 43. In this way, lifting of the trunk lid will become impossible because the pair of elongated rods 33 will block movement of the left hinge 13 and the right hinge 19. Only when the automobile engine is operating is the vacuum in the vacuum manifold available. Then, by opening the valve 67 the vacuum actuates the left and right cylinder assemblies 11, 17 thus causing the pair of elongated rods 33 to be pulled back to permit the trunk hinges 13, 19 freely to swing. Only then, is the opening of the trunk lid 15 possible.

It can be readily seen that this mechanism is an absolutely prevention from opening the trunk lid 15. The conduit means 58 is within the automobile and the elongated rod 33 is remote from the usual locking device.

The channel member 43 can be readily drilled with available tools and the locking mechanism can be installed inexpensively and quickly. The conduit means 58 can then be runned through the vehicle's interior compartment and connected the engine manifold along with the control valve 67.

A latitude of modification, change and substitution is intended in the foregoing disclosure, and in some instances some features of the invention will be employed without a corresponding use of other features.

I claim:

1. A locking mechanism for the trunk of a motor vehicle equipped with a trunk lid mounted on a pair of hinges, each of said hinges being pivotably mounted in one of a pair of channels with opposing sides facing one another, said motor vehicle including an internal combustion engine with a vacuum source, said locking mechanism comprising:

a cylinder means;

a piston means slidably mounted in said cylinder means;

an elongated rod secured at one end to said piston means;

means for mounting said cylinder means on one of the opposing sides of one of the channels with said elongated rod extendable into said channel, said means for mounting and said channel having an opening with said elongated rod slidably mounted therein;

spring means mounted within said cylinder means and engaging said piston means to extend said elongated rod into said channel to prevent pivoting of the pivotably mounted hinge within the channel on which said cylinder means is mounted;

conduit means connecting said cylinder means to said vacuum source to withdraw said piston and said elongated rod away from said channel in opposition to said spring means to permit pivoting of the pivotably mounted hinge; and valve means located within said conduit means to open and close said conduit means.

2. A locking mechanism according to claim 1 wherein:

said cylinder means is a hollow cylindrical member open at one end and closed at the other end; and said means for mounting said cylinder means includes a plate and a cap, said cap being secured to said plate and to the open end of said cylinder means.

3. A locking mechanism according to claim 2 wherein said cylinder means is threaded to said cap.

4. A locking mechanism according to claim 3 including means for fastening said plate to said channel, said fastening means including a pair of bolts.

5. A locking mechanism for the trunk of a motor vehicle equipped with a trunk lid mounted on a pair of hinges, each of the pair of hinges being pivotably mounted within one of a pair of channels, the opposing interior sides of said pair of channels having a hole predrilled therein, said motor vehicle including an internal combustion engine with a vacuum source, said locking mechanism comprising:

a pair of cylinder means;

a pair of piston means, each of said piston means being slidably mounted within one of the pair of cylinder means;

a pair of elongated rods, each of said elongated rods being secured at one end to one of the pair of piston means;

means for mounting said pair of cylinder means on the opposing interior sides of said pair of channels with said elongated rods directed away from one another;

a pair of spring means each mounted within said pair of piston means and each engaging one of the piston means to extend the pair of elongated rods into their respective channels to prevent pivoting of the respective hinge pivotably mounted within the channel on which said cylinder means is mounted;

conduit means connecting each cylinder means to said vacuum source to withdraw both pistons and both elongated rods away from said channels in opposition to their respective spring means; and valve means located within said conduit means to open and close said conduit means.

6. A locking mechanism according to claim 5 wherein said pair of cylinder means includes a pair of cylindrical hollow tubes each having a closed end and an open end, each open end being exteriorly threaded and each closed end having an inlet, said conduit means being connected to each cylinder means at said outlet.

7. A locking mechanism according to claim 6 wherein said means for mounting said pair of cylinder means includes:

a pair of cap means for enclosing the open ends of each of said pair of cylinder means, each of said cap means being interiorly threaded to engage the exterior thread of said pair of cylinders;

a pair of plates for mounting each of said channels on the pair of channels, each one of said caps being secured to one of said pair of plates, each of said plates having an opening in it; and means for mounting said plates on the opposing interior sides of both of said channels, said openings in each respective cap means and each plate means and each channel being aligned with one of the elongated rods being slidably mounted therein.

8. A locking mechanism according to claim 7 wherein said pair of elongated rods are mounted substantially on a common centerline.

9. A locking mechanism according to claim 8 wherein said conduit means includes a tee.

10. A locking mechanism according to claim 9 wherein said means for mounting said plates on the opposing interior sides of both of said channels includes a pair of bolts.

11. A locking mechanism for the trunk of a motor vehicle equipped with a trunk lid mounted on a pair of hinges, each of said hinges being pivotably mounted within one of a pair of channels with opposing sides facing one another, said motor vehicle including an internal combustion engine with a vacuum source, said locking mechanism comprising:

a cylinder, said cylinder being a hollow cylindrical member open at one end and closed at the other end with an external thread at the open end and an inlet at the closed end;

a piston slidably mounted in said cylinder;

an elongated rod secured at one end to said piston;

a cap having an internal thread adapted to engage the external thread at the open end of the cylinder, said cap having an opening located concentrically within it;

a plate adapted to be secured to one of the opposing sides of one of the channels, said cap being adapted to be secured to said plate, said plate and said channel each having an opening therein;

means for securing said cap to said plate and said plate to said channel, the openings in the cap and the plate and the channel being aligned with one another with the elongated rod slidably mounted therein;

a spring mounted within said cylinder between the closed end of the cylinder and the piston to extend the elongated rod into the channel to prevent pivoting of the pivotably mounted hinge within the channel;

a conduit connecting the closed end of the cylinder to the vacuum source to withdraw the piston and the elongated rod in opposition to the spring from the channel to permit pivoting of the pivotably mounted hinge within the channel; and a valve located within said conduit to open and close the conduit.

* * * * *